United States Patent [19]

Martin

[11] Patent Number: 4,615,046

[45] Date of Patent: Oct. 7, 1986

[54] SHOCK ABSORBER ELEMENT FOR FINGERS

[76] Inventor: John H. Martin, 4558 Barcroft Way, Sterling Heights, Mich. 48077

[21] Appl. No.: 664,552

[22] Filed: Oct. 25, 1984

[51] Int. Cl.[4] ..... A41D 19/00; A41D 13/00

[52] U.S. Cl. ..... 2/21; 273/29 R; 273/166; 273/26 C; 128/77

[58] Field of Search ..... 2/21, 161 A, 20, 163; 128/77, 87 A, 157; 254/19; 273/166, 54 B, 29 R, 26 C

[56] References Cited

U.S. PATENT DOCUMENTS

| | | | |
|---|---|---|---|
| 1,863,960 | 6/1932 | Aronson | 2/21 |
| 3,480,012 | 11/1969 | Smithers et al. | 128/157 X |
| 3,490,448 | 1/1970 | Grubb | 128/157 X |
| 3,922,724 | 12/1975 | Shockovsky | 273/166 X |
| 4,089,066 | 5/1978 | Dethman | 2/21 |
| 4,461,043 | 7/1984 | Lomedico | 2/21 |

*Primary Examiner*—George J. Marlo

*Attorney, Agent, or Firm*—Remy J. Van Ophem

[57] ABSTRACT

A shock absorber element for protecting one or more fingers which are engaging a tool from experiencing a shock load when the tool experiences an impact load. The shock absorber element includes at least one shock absorbing pad and an interconnector for interconnecting the at least one shock absorbing pad with one or more fingers. The at least one shock absorber pad may be two blocks of resilient material, such as synthetic foam rubber, surrounded by a thin flexible casing formed, for example, of a woven fabric, thermoplastic film, a rubberized nylon material, leather, or vinyl. The interconnector may consist of two or more thin elongated strips, each having a first end fitted between the two blocks of resilient material and a second end extending therefrom through a suitable aperture in the thin flexible casing. Each of the second ends are interconnectable, for example, by use of hook and burr fastening elements.

15 Claims, 4 Drawing Figures

SHOCK ABSORBER ELEMENT FOR FINGERS

BACKGROUND OF THE INVENTION

The present invention relates to shock absorber elements, especially shock absorber elements to protect fingers from a shock load experienced when fingers engage tools experiencing impact loads. More particularly, the present invention is directed to the problem of providing some protection to sufferers of arthritis and other similar conditions, from the pain and/or damage which otherwise might be experienced from such shock loads.

With the advances in the science of medicine in recent years, human life expectancy has increased dramatically. Furthermore, due to demographic changes, increasing percentages of the U.S. population are of advanced age. While a substantial number of these individuals suffer from various degrees of debilitating or painful conditions, such as arthritis, most of these individuals seek to continue to lead active lives.

Unfortunately, many of the activities in which such individuals participate involve the use of tools. These tools, when used, create extreme impact loads which are transferred through the tool to fingers of the individual user, often resulting in an unacceptable level of pain. These tools include hammers, golf clubs, and tennis rackets. What is needed, therefore, is an inexpensive, flexible, easily attachable and removable shock absorber element for protecting the fingers of such individuals from such shock loads.

Many protective devices have been devised in the past to protect fingers, palms, and wrists from the various impact loads which are encountered in various sports, such as an outfielder's glove and a catcher's mitt used in baseball. Furthermore, many special purpose gloves and protective devices have been offered in the past, such as the hitting mitt taught by U.S. Pat. No. 4,176,407, issued Dec. 4, 1979 to Goebel; the palm covering element taught by U.S. Pat. No. 3,496,573, issued Feb. 24, 1970 to Kuchar; the football glove taught by U.S. Pat. No. 4,295,229, issued Oct. 20, 1981 to Clark; the batter's glove taught by U.S. Pat. No. 4,042,975, issued Aug. 23, 1977 to Elliott; and the hand protector unit taught by U.S. Pat. No. 3,994,025, issued Nov. 30, 1976 to Petroski. However, none of these special purpose protectors and gloves provide shock protection to the fingers of the wearer without seriously limiting the freedom of movement of the hand. Furthermore, each of these special purpose gloves and protectors are bulky, heavy, and expensive to manufacture.

Accordingly, what is needed is a lightweight and compact shock absorbing element for fingers, which shock absorber element does not unduly limit the flexibility of the hand of the wearer.

SUMMARY OF THE PRESENT INVENTION

The invention includes a lightweight, compact, and inexpensive shock absorbing element which is easily interconnectable with one or more of the fingers of the wearer.

More particularly, the shock absorber element of the present invention includes at least one shock absorbing pad and an interconnector for removably interconnecting the at least one shock pad to at least one finger of the hand of the wearer.

In the preferred embodiment, the interconnector consists of at least two strips, each having one end interconnected with the at least one shock absorbing pad and a second end remote from the first end, each of the second ends being provided with an interconnection means, for example, burr and hook fastening means.

Moreover, in the preferred embodiment, the at least one shock absorbing pad consists of two shock absorbing pads, the first ends of the at least two strips being fitted between the two shock absorbing pads.

Furthermore, in the preferred embodiment, a thin flexible casing is fitted over the shock absorbing pads, such as to provide durability to the shock absorber element. The thin flexible casing may be a sheet of thermoplastic film which has been heat-bonded together or shrink-wrapped to surround the shock absorbing pads. Alternatively, the thin flexible casing may be formed of a woven fabric, a rubberized nylon material, leather, or vinyl which has been interconnected, for example, by means of threads, with the shock absorbing pads.

The principal object of the present invention is to provide a lightweight, inexpensive, easy to use shock absorber element for protecting at least one finger of a wearer from shock load when the finger engages a tool experiencing an impact load.

Another object of the present invention is to provide such a shock absorber element which does not unduly interfere with the free use of the operator's hand, including the bending of various knuckles associated with the finger when the shock absorber element is worn.

Yet another object of the present invention is to provide a shock absorber element of the type described above which is easily reversible so as to increase the effective lift thereof.

These and the many other objects, features, and advantages of the present invention will become apparent to those skilled in the art when the following detailed description of the preferred embodiment is read in conjunction with the drawings appended hereto.

BRIEF DESCRIPTION OF THE DRAWINGS

In the drawings appended hereto, wherein like reference numerals refer to like components throughout.

DETAILED DESCRIPTION OF THE PREFERRED EMBODIMENT

Figure 3:
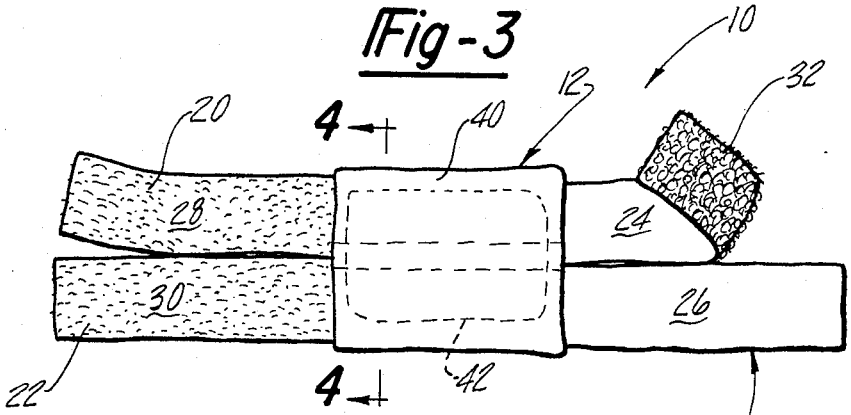
FIG. 3 is a further enlarged top plan view of the shock absorber element of FIG. 2 in an opened condition.

Referring now to the drawings, an example of structure for a shock absorber element 10 according to the present invention is illustrated. As best shown in FIG. 3, the shock absorber element 10 includes shock absorbing means 12 and interconnection means 14 for interconnecting the shock absorbing means 12 with one or more fingers of a wearer.

Figure 4:
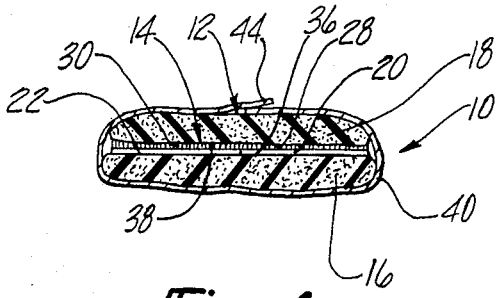
FIG. 4 is a sectional view taken along line 4—4 of FIG. 3.

The shock absorbing means 12 consists of one or more pads of resilient material. In the preferred embodiment, and as shown in the drawing of FIG. 4, the shock absorbing means 12 consists of a first shock absorbing pad 16 and a second shock absorbing pad 18. The first and second shock absorbing pads 16 and 18 are formed of sponge rubber or a similar resilient material and are preferably rectangular or oval in shape.

Figure 2:
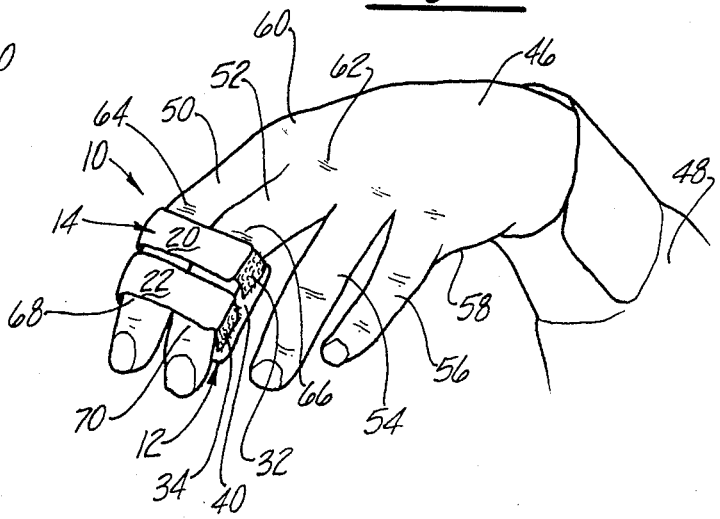
FIG. 2 is an enlarged perspective view of the shock absorber element of FIG. 1, attached to the fingers of the hand of a wearer.

The interconnection means 14 preferably consists of at least two strips of thistle cloth having fastening surfaces of the hook and burr types, known as Velcro, and currently avaiable from American Velcro, Inc. of Manchester, Vt. or Velcro S.A. Lenzerheide of Grisons, Switzerland. In the example illustrated, four strips, 20, 22, 24, and 26 are used. Two of the strips 20 and 22 are provided with hook-type fastening surfaces 28 and 30, respectively, as shown in FIGS. 3 and 4, while the other two strips 24 and 26 are provided with a pile or burr-type fastening surface 32 and 34, as shown in FIGS. 2 and 3.

When the shock absorber element 10 is assembled, one end of each of the strips 20, 22, 24, and 26 of thistle cloth is placed over a portion of a large flat surface 36 of the first shock absorbing pad 16, as shown in FIG. 4. The strips 20 and 22 of thistle cloth are disposed in a parallel, coplanar, and spaced apart relationship relative to each other. Each of the strips 20 and 22 of thistle cloth are oriented such that their respective hook-type fastening surfaces 28 and 30 are oriented in a first predetermined direction relative to the first shock absorbing pad 16. Similarly, the strips 24 and 26 of thistle cloth are arranged in a coplanar, parallel, spaced apart manner such that their respective pile or burr-type fastening surfaces 32 and 34 are directed in a second predetermined direction relative to the first shock absorbing pad 16, the second predetermined direction being opposite the first predetermined direction. Furthermore, the strips 20, 22, 24, and 26 of thistle cloth are arranged such that the strip 22 is axially aligned with the strip 26 while the strip 20 is axially aligned with the strip 24. A small amount of overlap, not shown in the drawing, may be provided between the adjacent ends of the strips 22 and 26, and between the adjacent ends of the strips 20 and 24, in a manner well known in the art, to secure the adjacent ends together during assembly, as will be appreciated by those skilled in the art.

Once the strips 20, 22, 24, and 26 of thistle cloth have been properly positioned relative to the first shock absorbing pad 16, the second shock absorbing pad 18 is placed over the adjacent ends of the strips 20, 22, 24, and 26 such as to trap the adjacent ends between the large flat surface 36 of the first shock absorbing pad 16 and a large flat surface 38 of the second shock absorbing pad. If desired, suitable adhesives may be provided between the strips 20, 22, 24, and 26 of thistle cloth and the first and second shock absorbing pads 16 and 18 to interconnect these elements. However, in the preferred embodiment, other interconnection means, described hereafter, are sufficient to interconnect these elements.

An outer wrap 40 of suitable material is provided to completely surround the first and second shock absorbing pads 16 and 18. The outer wrap 40 is, however, restricted in size so as to not interfere with the function of the pile or burr-type fastening surfaces 32 and 34, and the hook-type fastening surfaces 28 and 30 of the strips 20, 22, 24, and 26. The outer wrap 40 is provided to give the shock absorber element 10 more durability than would otherwise be available if the first and second shock absorbing pads 16 and 18 were exposed. The outer wrap 40 is, therefore, constructed from a suitable, durable, and attractive material, such as, for example, rubberized nylon material, real or synthetic leather material, vinyl material, a woven fabric, or a thermoplastic film. The choice of materials used for the outer wrap 40 will depend on the concern of the wearer for aesthetics, as well as other considerations, such as cost of manufacture, durability, and absorption of perspiration.

Depending on the choice of material for the outer wrap 40, various methods may be used for interconnecting the outer wrap 40 with the first and second shock absorbing pads 16 and 18. In the example illustrated, representative of the preferred embodiment, the outer wrap 40 is interconnected with the first and second shock absorbing pads 16 and 18 by means of one or more threads 42, shown only in FIG. 3, stitched repeatedly through the various layers of the outer wrap 40, the first and second shock absorbing pads 16 and 18, and the strips 20, 22, 24, and 26 of the thistle cloth. It will be appreciated by those skilled in the art that when stitching threads 42 are used to interconnect the outer wrap with the first and second shock absorbing pads 16 and 18, no additional means are required for interconnecting the strips 20, 22, 24, and 26 with the first and second shock absorbing pads 16 and 18.

Alternatively, when the outer wrap 40 is formed of a thermoplastic material, it may be wrapped around the first and second shock absorbing pads 16 and 18, as shown in FIG. 4, and secured thereto by a heat-bonded seam 44 between overlapping portions of the outer wrap 40 in the same general area as where the stitched thread appears in FIG. 3. Alternatively, the outer wrap 40 may consist of a thermoplastic film, not illustrated, which is first disposed about the first and second shock absorbing pads 16 and 18 and is subsequently heated and shrunk to fit snugly thereabout.

Figure 1:
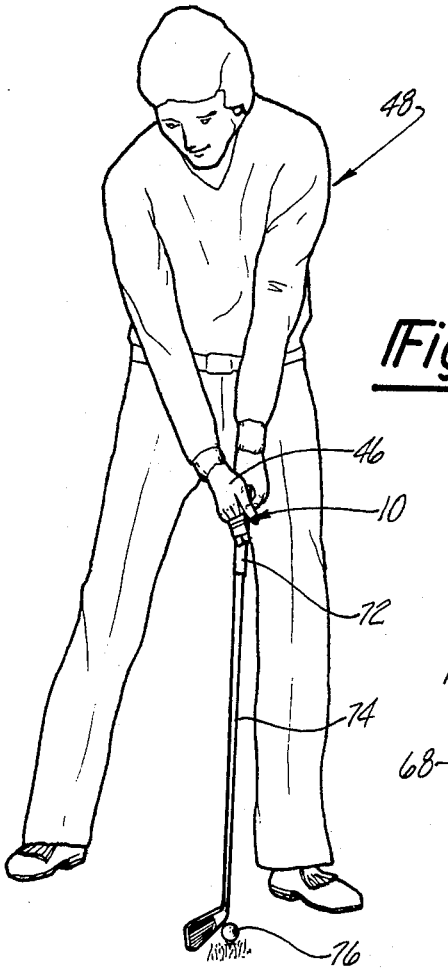
FIG. 1 is a perspective view of the shock absorber element according to the present invention as it is worn on the fingers of a wearer who is holding a golf club with the fingers.

As shown in FIGS. 1 and 2, the shock absorber element 10 of the present invention is interconnected with one or more fingers of a wearer. In the example illustrated, the shock absorber element 10 is interconnected with preselected fingers of a hand 46 of a golfer 48. As best shown in FIG. 2, the shock absorber element 10 of the present invention may be interconnected with two preselected fingers 50 and 52 of the hand 46. It will be appreciated by those skiled in the art that the shock absorber element 10 may be alternatively interconnected with any adjacent pairs of the fingers 50, 52, 54, and 56 of the hand 46, as desired. Furthermore, it will be appreciated that variations and modifications may be made to the shock absorber element 10 so as to permit its interconnection with one, three, or four fingers.

As shown in FIG. 2, the shock absorber element 10 is interconnected with the preselected fingers 50 and 52 by disposing the shock absorbing means 12 adjacent the underside of the fingers and wrapping the free ends of the strips 20, 22, 24, and 26 of thistle cloth about the two fingers 50 and 52, such as to bring each of the pile and burr-type fastening surfaces 32 and 34 into engagement with a repective one of the hook-type fastening surfaces 28 and 30.

The shock absorber element 10 of the present invention is proportioned such as to avoid interference with the normal function of the hand 46. Thus, the entire shock absorber element 10 is disposed remote from the palm 58 of the hand 46. Furthermore, the first and second shock absorbing pads 16 and 18 are proportioned such as to fit between adjacent knuckles of the fingers 50 and 52. Thus, the shock absorber element 10 does not interfere with the articulation of the first knuckles 60 and 62, the second knuckles 64 and 66, or the third knuckles 68 and 70, respectively, of the fingers 50 and 52. Furthermore, the flexibility of the knuckles 64 through 70 is further facilitated by the use of two sets of spaced apart strips of thistle cloth for the interconnection means 14.

In use, as shown in FIG. 1, the golfer 48 grips a handle 72 of a golf club 74 in a normal manner and swings the golf club toward a golf ball 76. The shock absorber element 10 is comfortable and does not interfere with the golfer's swing or his control of the club. However, the shock absorber element 10 absorbs the shock load which would otherwise be absorbed by the fingers 50 and 52 when the golf club 74 encounters the golf ball 76 and/or the ground.

The above detailed description is offered by way of example and not by way of limitation. It will be appreciated by those skilled in the art that many variations and modifications may be made to the shock absorber element of the present invention without departing from the spirit of the present invention. For example, for other uses, a shock absorber element may include shock absorbing means extending along the entire length between the first and third knuckle, where substantial articulation of the second knuckle is not required, for example, for use in conjunction with a hammer. These and the many other variations and modifications within the spirit of the present invention are included within the intended scope of the claims appended hereto.

What is claimed as novel is as follows:

1. A shock absorber element for protecting at least one finger of a hand of an operator of a tool from a shock load when said at least one finger engages said tool experiencing an impact load, said shock absorber element comprising:

at least one thin resilient shock absorbing pad, said at least one thin resilient shock absorbing pad having a first flat surface and a second flat surface opposite thereto;

at least two thin elongated strips, each of said at least two thin elongated strips having a first end interconnected with said at least one thin resilient shock absorbing pad and a second end disposed remote from said first end;

burr fastening means depending from said second end of one of said at least two thin elongated strips;

hook fastening means depending from said second end of the other of said at least two thin elongated strips, said hook and burr fastening means removably fastening said second end of one of said at least two thin elongated strips to said second end of the other of said at least two thin elongated strips when said at least two thin elongated strips are selectively wound about said at least one finger;

a flexible outer wrap casing means disposed about said at least one thin resilient shock absorbing pad and each of said first end of said at least two thin elongated strips, such as to surround the interconnection of said first ends of each of said at least two thin elongated strips and said at least one thin resilient shock absorbing pad; and means for attaching said flexible outer wrap casing means to said at least one thin resilient shock absorbing pad and said first end of each of said at least two thin elongated strips whereby when said at least two thin elongated strips are wound about said at least one finger and fastened thereto, said at least one thin resilient shock absorbing pad fases in the same direction as the palm of the hand such that the shock of a hand held tool experiencing an impact load may be absorbed by the at least one thin resilient shock absorbing pad.

2. The shock absorber element as claimed in claim 1 wherein said at least one thin resilient shock absorbing pad comprises a thin rectangular block of resilient material.

3. The shock absorber element as claimed in claim 1 wherein said at least one thin resilient shock absorbing pad is comprised of synthetic foam rubber.

4. The shock absorber element as claimed in claim 1 wherein said flexible outer wrap casing means is interconnected with said at least one thin resilient shock absorbing pad by a stitched thread.

5. The shock absorber element as claimed in claim 1 wherein said flexible outer wrap casing means is comprised of a sheet of woven fabric.

6. The shock absorber element as claimed in claim 1 wherein said flexible outer wrap casing means is comprised of a sheet of rubberized nylon material.

7. The shock absorber element as claimed in claim 1 wherein said flexible outer wrap casing means is comprised of a sheet of leather.

8. The shock absorber element as claimed in claim 1 wherein said flexible outer wrap casing means is comprised of a sheet of vinyl.

9. The shock absorber element as claimed in claim 1 wherein said flexible outer wrap casing means is comprised of a sheet of thermoplastic film.

10. The shock absorber element as claimed in claim 9 wherein said flexible outer wrap casing means is heat-bonded together, such as to completely surround said at least one thin resilient shock absorbing pad.

11. The shock absorber element as claimed in claim 10 wherein said flexible outer wrap casing means is shrink-wrapped about said at least one thin resilient shock absorbing pad.

12. The shock absorber element as claimed in claim 1 wherein said at least two thin elongated strips comprise exactly four thin elongated strips, and further wherein said burr and hook fastening means is removably fastened in preselected pairs of said exactly four thin elongated strips to each other, such as to fasten said shock absorber element to said at least one finger.

13. The shock absorber element as claimed in claim 1 wherein said at least one thin resilient shock absorbing pad comprises two thin rectangular blocks of resilient material, said two thin rectangular blocks of resiient material being interconnected with each other in a parallel relationship, said first end of each of said two thin elongated strips being disposed between said two thin rectangular blocks of resilient material.

14. A shock absorber element for protecting at least two adjacent fingers of a hand of an operator of a tool from a shock load when said at least two adjacent fingers are engaged with said tool and said tool experiences an impact load, said shock absorber element comprising:

a first thin resilient shock absorbing pad having a first flat surface and a second flat surface opposite thereto;

a first thin elongated strip having a first end overlying said first flat surface of said first thin resilient shock absorbing pad and a second end remote from said first end;

burr fastening means depending from said second end of said first thin elongated strip;

a second thin elongated strip having a third end overlying said first flat surface of said first thin resilient shock absorbing pad and a fourth end remote from said first, second, and third ends of said first and second thin elongated strips;

hook fastening means depending from said fourth end of said second thin elongated strip, said hook fastening means being selectively and removably engageable with said burr fastening means;

a second thin resilient shock absorbing pad having a third flat surface overlying said first flat surface of said first thin resilient shock absorbing pad and a fourth flat surface opposite thereto, said first end of said first thin elongated strip and said third end of said second thin elongated strip being thereby disposed between said first and second thin resilient shock absorbing pads; and interconnection means interconnecting said first thin resilient shock absorbing pad, said second thin resilient shock absorbing pad, said first end of said first thin elongated strip, and said third end of said second thin elongated strip.

15. The shock absorber element as claimed in claim 14 further comprising thin flexible outer wrap casing means disposed about said second flat surface of said first thin resilient shock absorbing pad and said fourth flat surface of said second thin resilient shock absorbing pad, such as to surround said first and second thin resilient shock absorbing pads.

* * * * *

UNITED STATES PATENT AND TRADEMARK OFFICE

CERTIFICATE OF CORRECTION

PATENT NO. : 4,615,046

DATED : October 7, 1986

INVENTOR(S) : John H. Martin

It is certified that error appears in the above-identified patent and that said Letters Patent is hereby corrected as shown below:

Column 1, line 65, after "shock" insert ---- absorbing ----.

Column 2, line 33, delete "lift" and insert ---- life ----.

Column 3, line 9, delete "avaiable" and insert ---- available ----.

Column 4, line 20, after "outer wrap" insert ---- 40 ----.

Column 4, line 44, delete "skiled" and insert ---- skilled ----.

Column 4, line 58, delete "repective" and insert ---- respective ----.

UNITED STATES PATENT AND TRADEMARK OFFICE

CERTIFICATE OF CORRECTION

PATENT NO. : 4,615,046

DATED : October 7, 1986

Sheet 2 of 2

INVENTOR(S) : John H. Martin

It is certified that error appears in the above-identified patent and that said Letters Patent is hereby corrected as shown below:

In the Claims

Column 5, line 68, delete "fases" and insert ---- faces ----.

Column 6, line 36, delete "10" and insert ---- 9 ----.

Column 6, line 49, delete "resiient" and insert ---- resilient ----.

Signed and Sealed this

First Day of September, 1987

*Attest:*

*Attesting Officer*

DONALD J. QUIGG

*Commissioner of Patents and Trademarks*